United States Patent [19]

Shrader et al.

[11] 4,411,198

[45] Oct. 25, 1983

[54] IMPACT FUZE

[75] Inventors: John E. Shrader, Mercer Island; Alan B. Zimmerschied, Renton, both of Wash.

[73] Assignee: The Boeing Company, Seattle, Wash.

[21] Appl. No.: 247,076

[22] Filed: Mar. 24, 1981

[51] Int. Cl.[3] ..... F42C 19/06

[52] U.S. Cl. ..... 102/216

[58] Field of Search ..... 102/216, 201, 262, 272

[56] References Cited

U.S. PATENT DOCUMENTS

| | | | |
|---|---|---|---|
| 2,728,296 | 12/1955 | Meister | 102/70.2 |
| 3,588,811 | 6/1971 | Prickett | 340/52 |
| 3,714,644 | 1/1973 | Hellstrom | 340/274 |
| 3,910,105 | 10/1975 | Hoffstedt | 73/88 A |
| 4,020,765 | 5/1977 | Glass et al. | 102/70.2 R |
| 4,036,142 | 7/1977 | Williams | 102/70.2 R |

*Primary Examiner*—Charles T. Jordan

*Attorney, Agent, or Firm*—Schwartz, Jeffery, Schwaab, Mack, Blumenthal & Koch

[57] ABSTRACT

An optical impact fuze employing a transparent nose of a target seeking missile as a light transmission medium which deforms upon impact to reduce optical transmission and initiate a fuzing signal. Alternatively, one or more optically transmissive filaments can be positioned at or near a predetermined target impact point on a vehicle so that a fuzing signal is initiated upon the detection of an abrupt decrease in light transmitted by the filament resulting from target contact.

11 Claims, 2 Drawing Figures

IMPACT FUZE

BACKGROUND OF THE INVENTION

1. Field of the Invention

This invention generally relates to an impact sensor and, more particularly, to an optical impact fuze for initiating a warhead detonation.

2. Prior Art

In many weapon systems utilizing a shaped charge or a nuclear warhead, it is essential that an impact fuze signal provide detonation as quickly as possible after target contact to prevent damage to the warhead and provide a critical standoff distance necessary for optimum performance. Typically, contact detonation requires some form of communication between an impact sensor situated at or near a target contact point on the delivery vehicle and a detonator which, in many cases, resides at the rear of the warhead. Ideally, the impact sensor should produce a fuzing signal within two microseconds of initial contact, although this time period may vary somewhat depending upon the velocity of the warhead and the vehicle.

The prior art contains numerous examples of contact sensors designed to achieve a fuzing signal shortly after impact. Often, an ogive is located at the front of the vehicle and includes a shaped charge which is activaged on impact to provide a stream of particles projected back towards the warhead to initiate warhead detonation. Alternatively, a closure or crusher switch, located at the nose of the vehicle, mechanically or electrically completes a fuzing circuit to provide a fuzing signal on impact. Also known are optical proximity fuzes such as disclosed by U.S. Pat. No. 4,036,142 providing a fuzing signal upon sensing a substantial change in the reflected or ambient light at the fuze. These prior art devices require materials to be placed at the nose of the vehicle and in front of the blase jet in its formative stages.

Some warheads are provided with optical seekers, and these require an optically transparent dome in order to provide an unobstructed view. Impact sensors of the prior art can, therefore, not be placed on the dome of the vehicle. As a result, impact sensors are placed aft of the dome and detect a stress wave generated by impact in order to provide a detonation signal. Because the stress wave must travel from the point of impact to the sensor, a delay results of approximately 2.5 microseconds per centimeter of distance travelled. In addition, the wave is spread and attenuated resulting in an increased delay between target contact and detonation which can significantly increase the delay between initial contact and fuzing.

SUMMARY OF THE INVENTION

Accordingly, it is an object of this invention to provide a fuzing arrangement for use with vehicles having an optically transparent nose which avoids the abovementioned disadvantages of the prior art.

Another object of the present invention is to provide a fuze which utilizes the optically transparent nose of a vehicle to sense target contact.

One advantage of the present invention is that it provides an impact fuze capable of producing a fuzing signal within an acceptably short time period after target contact.

Another advantage of the present invention is that it provides an impact fuze constructed to prevent interference with the path of a jet blast from a shaped charge.

In accordance with the principles of the present invention, a transparent nose dome of a vehicle is provided with a source of collimated light and a photodetector arranged so that the transparent nose serves to conduct light from the light source to the detector. The nose creates an optical wave guide by virtue of multiple internal reflections within the thickness of the optically transparent nose material. The critical angle (and hence acceptance angle for the light source for the fuze) is determined by the difference in index of refraction of the nose material and the surrounding material (typically air). The light conveyed by the transparent nose is measured by the detector which produces a fuzing signal in response to an abrupt decrease in light intensity occurring as the nose impacts with a target. In another embodiment, an optically transmissive filament is utilized to convey light from the light source of the photodetector. In this case, a portion of the transmission line is located at or near a predetermined target contact point on the vehicle. The detector produces a fuzing signal upon sensing an abrupt decrease in light intensity as the filament is compressed, severed, or broken upon impact with the target.

BRIEF DESCRIPTION OF THE DRAWINGS

The foregoing and other objects, features, and advantages of the invention will be apparent from the following more particular description of the preferred embodiments of the invention, as illustrated in the accompanying drawings in which like reference characters refer to the same parts throughout different views. The drawings are not necessarily to scale, emphasis instead being placed upon illustrating the principles of the invention.

DETAILED DESCRIPTION OF THE PREFERRED EMBODIMENTS

Figure 1:
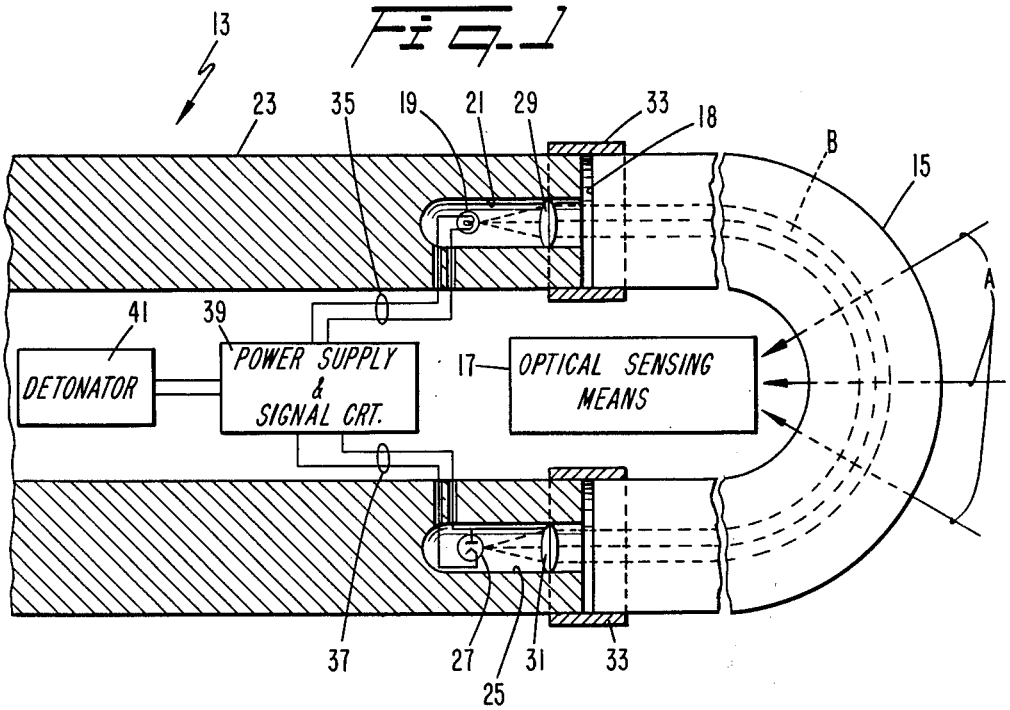
FIG. 1 is a sectional view of an optical impact fuze utilizing the optically transparent dome of a vehicle as an impact sensor.

Referring to FIG. 1, an optical impact fuze is shown for use with a missile 13 having an optical, target seeking, guidance system employing an optically transparent nose dome 15. The nose dome 15 is transparent to optical radiation (visible or invisible) which may enter in the direction generally indicated by arrows A. Optical sensing means 17 are provided within the missile 13 to receive the radiation for missile guidance purposes. In accordance with the principles of the invention, the nose dome 15 may also be utilized to transmit radiation through its thickness in the direction indicated by path B, although the exact optical path would be reflected multiple times off the walls of the nose dome 15. The nose dome 15 thus serves as an optical wave guide. Adjacent one end 18 of the nose dome 15 is a light source 19 (or a plurality of light sources) which may comprise, for example, a small incandescent bulb or a LED. The light source 19 is secured within a bore 21 in a wall 23 of the missile 13. For multiple light sources, separate bores may be utilized, one for each light source. On the opposite side of bore 21, another bore 25 is provided within the wall 23, and this bore is utilized to house light receiving means 27. The light receiving means 27 may comprise, for example, a PIN photodiode. For multiple light sources, corresponding light receiving means are utilized. Optical elements such as lenses 29 are 31 may be associated respectively with the light source 19 and light receiving means 27 to help collimate and focus the transmitted light. Coupling means 33 may be provided in the missile 13 for securing the nose dome 15 to the missile wall 23. Optical fibers may also be utilized for coupling the light source to the nose and/or the light receiving means to the nose. Electrical leads 35 and 37 are provided from the light source 19 and light receiving means 27 respectively to a power supply and signal circuit 39. The light receiving means produces a signal in the nature of a voltage or current pulse which is initiated in response to a change in the intensity of the received light. The signal is generated upon impact of the nose dome, which impact reduces the light transmission paths therethrough. The power supply and signal circuit 39 detects the signal indicative of the decrease in the light intensity and generates a detonation signal to a detonator 41. The power supply and signal circuit 39 also provides the necessary power to energize light source 19. The power supply and signal circuit 39 may be of conventional construction such as that illustrated in U.S. Pat. No. 4,036,142 incorporated herein by reference.

At impact, the nose dome 15 serves as an optical contact sensor due, for example, to the abrupt decrease in its light transmitting qualities resulting from fracture planes, changes in the index of refraction due to compression, or reduced internal reflection caused by contact with a target of higher index of refraction than air. The response time for changes in the light transmission intensity is extremely rapid in comparison with shock wave responsive sensors. Thus, the signal provided by the power supply and signal circuit 39 to the detonator is quite rapid and permits detonation of the warhead within acceptably small times after initial contact.

Figure 2:
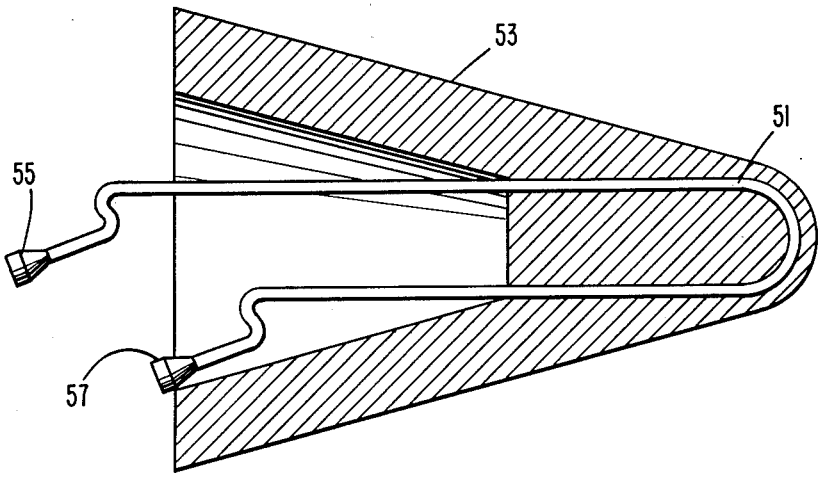
FIG. 2 is a sectional view of an alternative embodiment of the present invention utilizing an optically transmissive filament.

FIG. 2 illustrates an alternative embodiment of the present invention utilizing an optically transmissive filament 51 as a contact sensing arrangement in a missile having a non-transparent nose 53. The filament may be an optical fiber which conveys light in the visible or invisible spectrum from a light source 55 to a photodetector 57. A portion of the filament 51 is located at or near a predetermined target contact point on the nose 53. Upon impact, the filament 51 is compressed resulting in an abrupt decrease in light transmitted. The decreased light intensity is sensed by the light detector 57. A power supply and signal circuit (not shown) is provided similar to that of FIG. 1 for permitting generation of a detonation signal to a detonator. The light source 55 and photodetector 57 can be conveniently located at the base of the warhead, and only a portion of the filament 51 need be situated at or near the predetermined target contact point. The remote location of the detector 57 permits sufficient time for the detector to respond to the decreased light intensity prior to impact damage.

Additionally, other filaments 51 and the same or other light sources and receivers may be used to cover various predetermined expected impact areas of the nose.

In the embodiment of FIG. 1, it is noted that the nose comprises a continuous curved body having an apex area which is the forward tip portion of the nose. Light transmitted from the light source 19 is contained within the body of the nose 15 (by internal reflections) and transmitted to the light receiving means 27, which is shielded from other light. Other housing or containment means may clearly be devised to shield the light receiving means 27. In a similar fashion, the use of fiber optics in the embodiment of FIG. 2 serves to shield the light receiving means 57 from optical radiation other than that transmitted by the light source 55.

While the invention has been particularly shown and described with reference to preferred embodiments thereof, it will be understood by those skilled in the art that various changes in form and detail may be made therein without departing from the spirit and scope of the invention. For example, while only a single optically transmissive filament is illustrated, it is understood that a plurality of filaments can be conveniently located within the nose cone of a warhead.

We claim:

1. An impact fuze for use in a warhead assembly having a nose made of optically transparent material comprising:

(a) light generating means for producing a light beam, (b) light receiving means, (c) said light generating means and said light receiving means spacedly positioned from one another for enabling said light beam to travel from said light generating means, through a path in said optically transparent nose material and to said light receiving means, and (d) circuit means coupled to said light receiving means for producing a signal upon the detection of an abrupt change in sensed light by said light receiving means.

2. A fuze as recited in claim 1 wherein said light source produces light in the visible spectrum.

3. A fuze as recited in claim 1 wherein said light source produces light in the invisible spectrum.

4. A fuze as recited in claim 1 further comprising circuit means for detecting said signal and for generating a fuzing signal in response thereto.

5. A fuze as recited in claim 1 wherein:

said nose comprises a continuous curved body optically transparent to radiation passing therethrough and entering the interior of said assembly.

6. A fuze as recited in claim 5 further comprising means for shielding said light receiving means from light other than light traveling thereto along said path.

7. An impact fuze as recited in claim 1, wherein said light generating means comprises a light source and means for directing light from said light source to said nose.

8. An impact fuze as recited in claim 1, wherein said light receiving means comprises a light receiver and means for directing said light beam from said nose to said light receiver.

9. An impact fuze as recited in claim 7, wherein said light directing means comprises an optical fiber.

10. An impact fuze as recited in claim 8, wherein said light directing means comprises an optical fiber.

11. An impact fuze as recited in claim 1, further comprising means for shielding said light receiving means from light other than light traveling thereto along said path.

* * * * *